US010800620B2

(12) United States Patent
Kannari

(10) Patent No.: US 10,800,620 B2
(45) Date of Patent: Oct. 13, 2020

(54) SHEET FEEDING APPARATUS AND IMAGE FORMING APPARATUS

(71) Applicant: CANON KABUSHIKI KAISHA, Tokyo (JP)

(72) Inventor: Isao Kannari, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 29 days.

(21) Appl. No.: 16/295,111

(22) Filed: Mar. 7, 2019

(65) Prior Publication Data

US 2019/0283987 A1 Sep. 19, 2019

(30) Foreign Application Priority Data

Mar. 13, 2018 (JP) ..... 2018-045879

(51) Int. Cl.
*B65H 1/04* (2006.01)

(52) U.S. Cl.
CPC ..... *B65H 1/04* (2013.01); *B65H 2405/324* (2013.01); *B65H 2405/354* (2013.01); *B65H 2405/361* (2013.01)

(58) Field of Classification Search
CPC ..... B65H 1/04; B65H 2402/31; B65H 2405/324; B65H 2405/354; B65H 2405/361
USPC ..... 271/162
See application file for complete search history.

(56) References Cited

U.S. PATENT DOCUMENTS

| | | | | |
|---|---|---|---|---|
| 7,712,734 | B2 * | 5/2010 | Kang | B65H 1/04 271/162 |
| 8,480,074 | B2 | 7/2013 | Ubayashi et al. | |
| 9,540,192 | B2 | 1/2017 | Kannari | |
| 2011/0266743 | A1 | 11/2011 | Yamamoto | |
| 2013/0011174 | A1 * | 1/2013 | Lee | G03G 15/6514 399/381 |
| 2016/0122140 | A1 * | 5/2016 | Furusawa | B65H 1/04 271/147 |

* cited by examiner

*Primary Examiner* — David H Bollinger
(74) *Attorney, Agent, or Firm* — Venable LLP

(57) ABSTRACT

A sheet feeding apparatus includes a casing; a sheet stacking unit rotatable between a closing position and first and second opening positions; a sheet feeding unit; a link unit provided with a slidable engaging portion; and a spring. The sheet stacking unit includes a first guide; and a second guide branching from the first guide. The first guide includes a first portion, a first supporting portion, and a second portion. The second guide includes a second supporting portion. The engaging portion is guided from the second guide to the first portion of the first guide by the sheet stacking unit being closed from the second opening position, and the engaging portion is guided from the first portion of the first guide to the second portion by way of the branch portion by the sheet stacking unit being opened from the closed state.

8 Claims, 8 Drawing Sheets

(a)

(b)

(a)

(b)

(a)

(b)

SHEET FEEDING APPARATUS AND IMAGE FORMING APPARATUS

FIELD OF THE INVENTION AND RELATED ART

The present invention relates to a sheet feeding apparatus which feeds sheets of recording medium, and an image forming apparatus equipped with a sheet feeding apparatus.

There has been known an image forming apparatus equipped with a manual sheet feeding portion. A manual sheet feeding portion is made up of a manual sheet feeding tray in which sheets of recording medium are held in layers, and such rollers as a pickup roller which moves one or more sheets of recording medium out of the tray, a feed roller which feeds sheets of recording medium into the main assembly of the image forming apparatus, and a retard roller which separates the sheet of recording medium, which is in contact with the feed roller, from the rest. As these rollers are reduced in diameter by friction, and/or paper dust adheres to these rollers, it becomes impossible for the sheet feeding apparatus to satisfactorily feed sheets of recording medium into the main assembly of an image forming apparatus. It is therefore a common practice to replace the roller(s), as the cumulative number by which sheets of recording medium were fed into the main assembly of the image forming apparatus exceeds a preset threshold value.

Thus, in order to improve an image forming apparatus in terms of the accessibility to these rollers during a maintenance period, there has been proposed an image forming apparatus structured so that its manual feeding tray is changeable in the angle relative to the main assembly of the image forming apparatus (which hereafter may be referred to as apparatus main assembly). For example, the image forming apparatus disclosed in Laid-open U.S. Patent Application No. 2011/0266743, is structured so that when it is necessary to carry out a maintenance operation, a user can change the sheet feeding portion of the apparatus in attitude from the second attitude in which sheets can be fed into the main assembly of the image forming apparatus, to the third attitude which is for the maintenance of the image forming apparatus. More specifically, as force is continuously applied to the manual feeding tray by the user in the direction to open the tray, that is, the direction to rotationally move the tray away from the apparatus main assembly, when the manual feeding tray is in the second attitude, the tray changes in attitude to the third one, increasing thereby the space above the manual sheet feeding tray. Further, after the completion of the maintenance operation, the manual sheet feeding tray changes in attitude from the third one to the second one as the force which has been continuously applied to the tray is removed.

However, in the case of the image forming apparatus disclosed in Laid-open U.S. Patent Application No. 2011/0266743, in order to keep wide the space above the manual sheet feeding tray, a certain amount of force has to be continuously applied to the tray. Thus, this image forming apparatus could be said to be always easy to maintain. Further, after the completion of the maintenance operation, if a maintenance person forgets to remove the force, which has been continuously applied to the manual sheet feeding tray, the tray will be held at an angle which is different from the one at which it is to be held during the feeding of sheets of recording medium, making it possible that the sheet feeding portion will malfunction; for example, it will fail to feed a sheet of recording medium, or feed two or more sheets together.

SUMMARY OF THE INVENTION

The primary object of the present invention is to provide a sheet feeding apparatus which prevents the occurrence of sheet feeding errors, without being reduced in maintainability. It also relates to an image forming apparatus having a sheet feeding apparatus which is in accordance with the present invention.

According to an aspect of the present invention, there is provided a sheet feeding apparatus comprising a casing; a sheet stacking unit configured to accommodate a stack of sheets, said stacking unit is movable relative to said casing to open and close said casing; a sheet feeding unit configured to feed the sheet from said sheet stacking unit; a link unit rotatably supported by said casing, said link unit being provided with an engaging portion slidably engaged with said sheet stacking unit; a spring configured to urge said link unit relative to said casing in a closing direction; wherein said sheet stacking unit is rotatable between a closing position for closing said casing, a first opening position for opening said casing by a predetermined angle, and a second opening position for opening said casing by an angle larger than the predetermined angle, and said sheet stacking unit including, a first guide configured to guide said engaging portion when said sheet stacking unit is opened from the closing position to the first opening position, and a second guide configured to guide said engaging portion when said sheet stacking unit is opened from the first position to the second position, said second guide branching from said first guide; wherein said first guide includes, a first portion configured to guide said engaging portion to said branch portion when said sheet stacking unit rotates from the closing position to the first opening position, a first supporting portion configured to support said engaging portion when said sheet stacking unit is in the first opening position, said first supporting portion extending from said branch portion in a direction different from a direction in which said second guide extends, and a second portion configured to guide said engaging portion between said branch portion and said first supporting portion; wherein said second guide includes a second supporting portion configured to support said engaging portion when said sheet stacking unit is in the second opening position and configured to guide said engaging portion between said branch portion and said second supporting portion; wherein said engaging portion is guided from said second guide to said first portion of said first guide by said sheet stacking unit being closed from the second opening position, and said engaging portion is guided from said first portion of said first guide to said second portion by way of said branch portion by said sheet stacking unit being opened from the closed state.

According to the present invention, it is possible to prevent a sheet feeding apparatus from making sheet feeding errors, without reducing the apparatus in maintainability.

Further features of the present invention will become apparent from the following description of exemplary embodiments with reference to the attached drawings.

Figure 2:
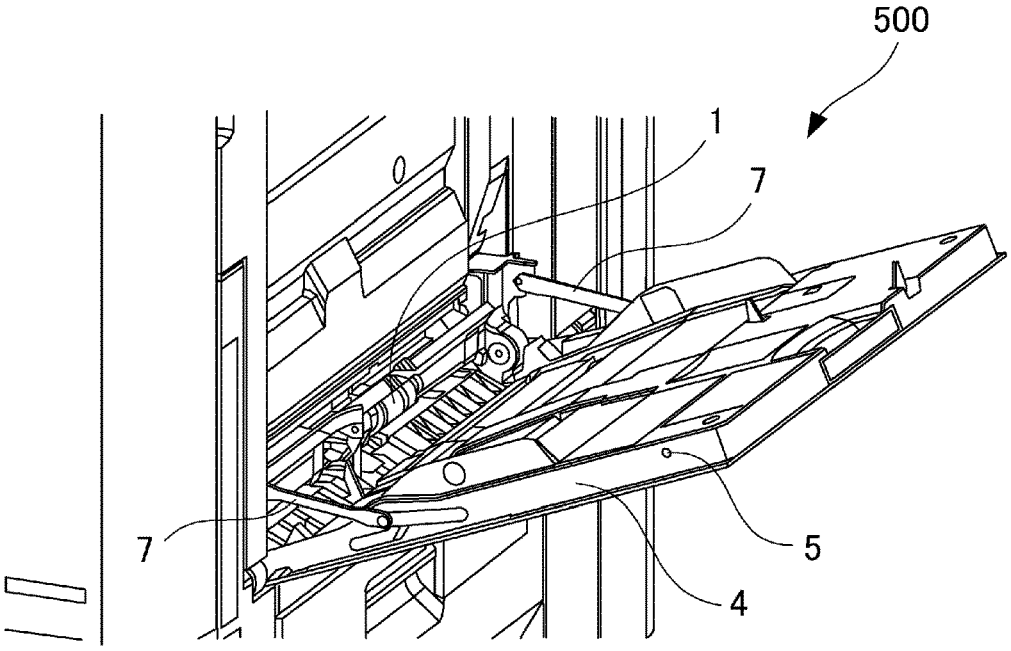
Figure 2:
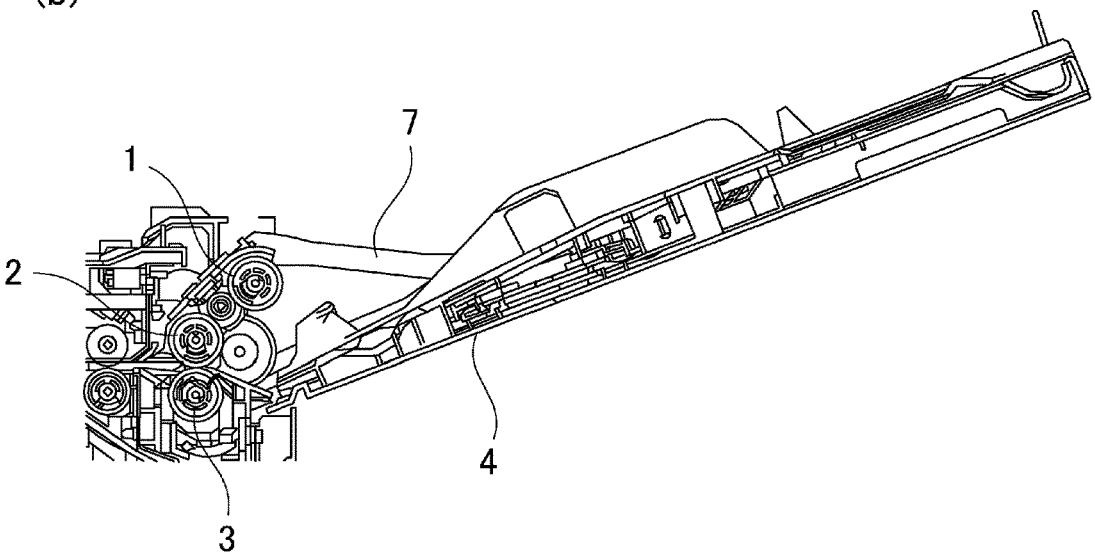

Parts (a) and (b) of FIG. 2 are schematic views of the sheet feeding apparatus in the first embodiment, which is for showing the general structure of the apparatus, part (a) of FIG. 2 being a perspective view of the apparatus when the sheet supporting portion of the apparatus is in the first state of being open, and part (b) of FIG. 2 being a partially sectional side view of the apparatus.

Figure 3:
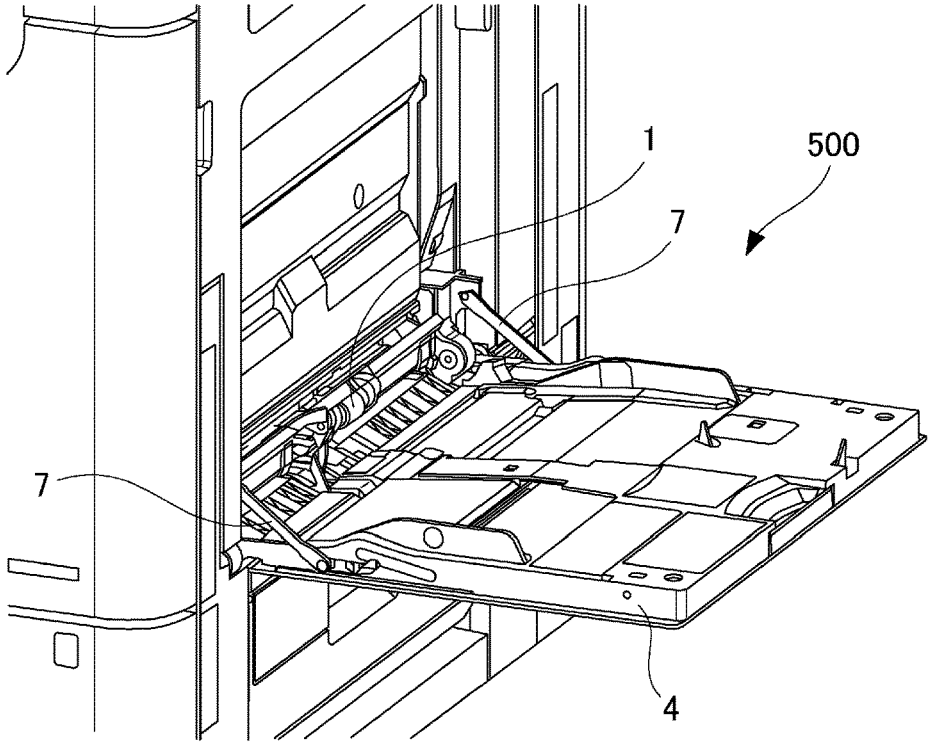
Figure 3:
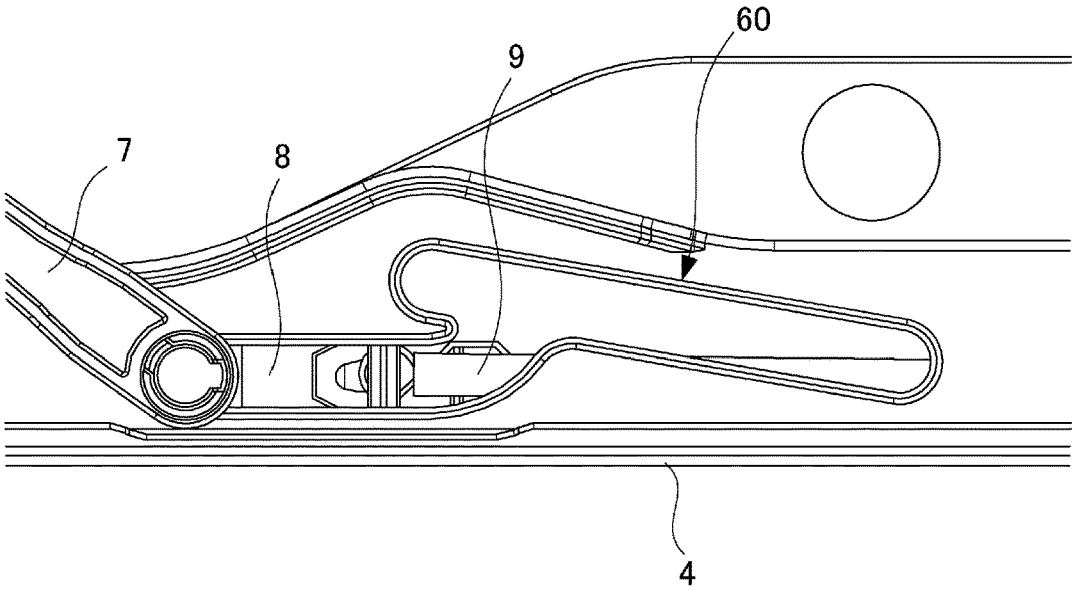

Parts (a) and (b) of FIG. 3 are schematic views of the sheet feeding apparatus in the first embodiment, which is for showing the general structure of the apparatus when the sheet supporting portion of the apparatus is in the second state of being open, part (a) of FIG. 3 being a perspective view of the sheet supporting portion, and part (b) of FIG. 3 being an enlarged sectional view of a part of the apparatus, which includes the guiding portion of the sheet supporting portion.

Figure 4:
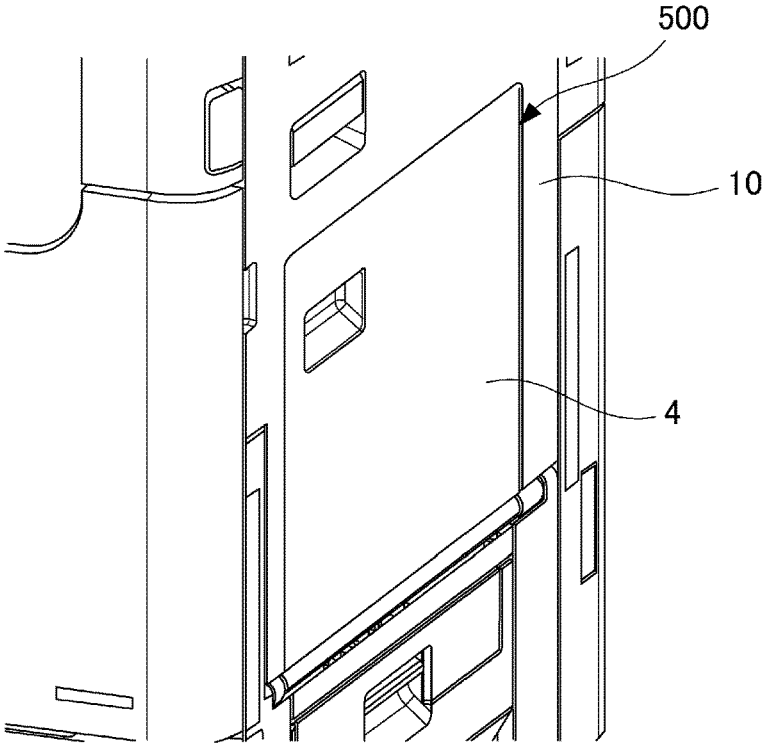
Figure 4:
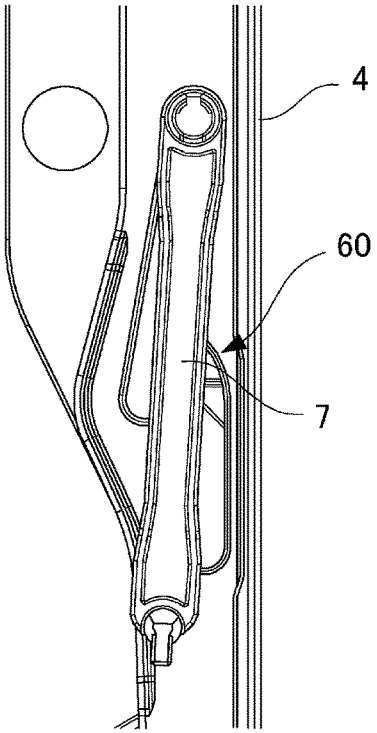

Parts (a) and (b) of FIG. 4 are views of the sheet feeding apparatus in this embodiment when the sheet supporting portion of the apparatus is in the state of being completely shut, part (a) of FIG. 4 being a perspective view of the sheet supporting portion, and part (b) of FIG. 4 being an enlarged side view of the portion of the apparatus, which includes the first and second guides of the sheet supporting portion.

Figure 5:
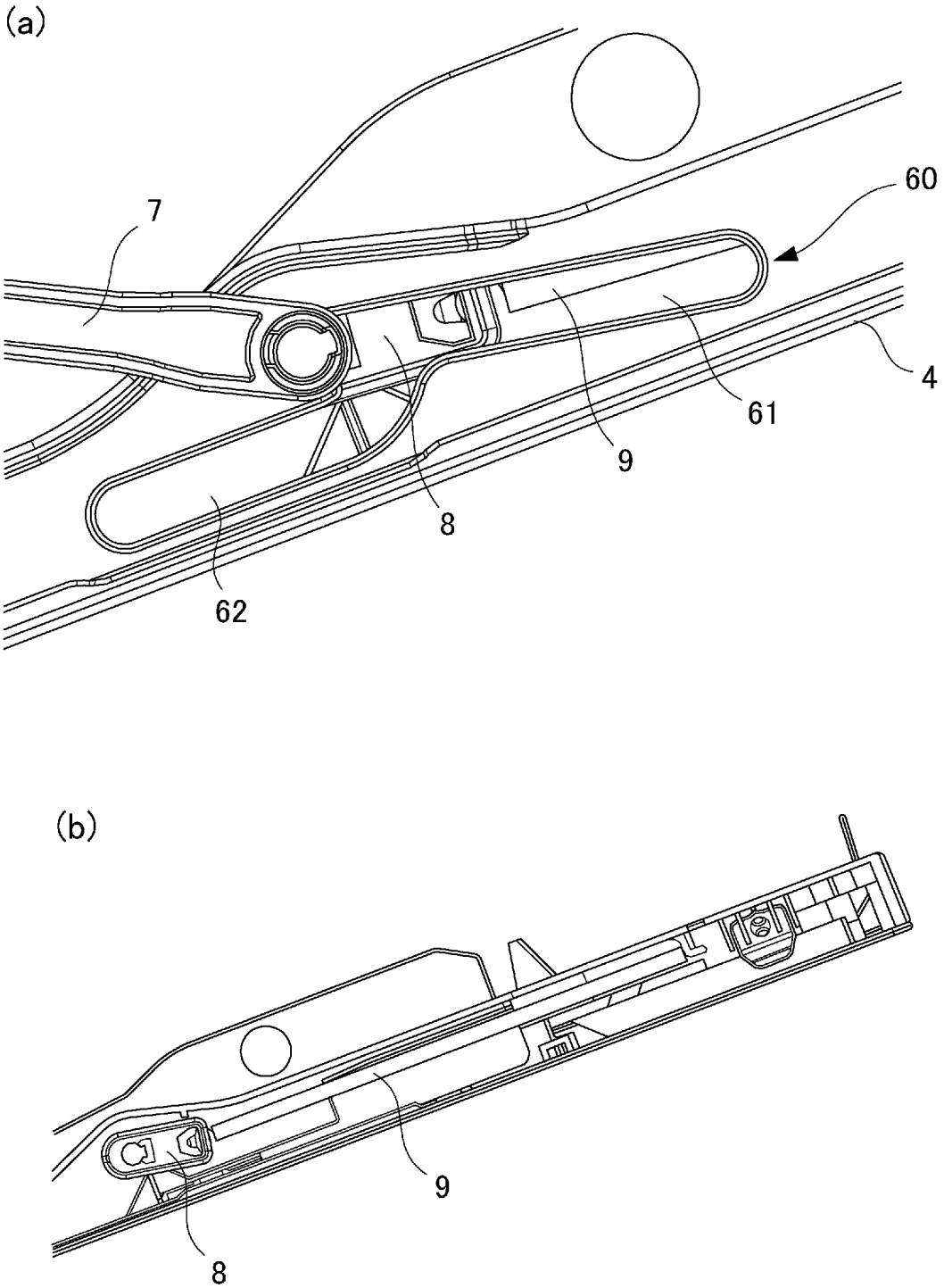

Parts (a) and (b) of FIG. 5 are views of the sheet supporting portion of the sheet feeding apparatus in this embodiment when the sheet supporting portion is in the first state of being open, part (a) of FIG. 5 being an enlarged side view of the portion of the sheet supporting portion, which includes the guide portion of the sheet supporting portion, part (b) of FIG. 5 being a sectional view of the sheet supporting portion.

Figure 6:
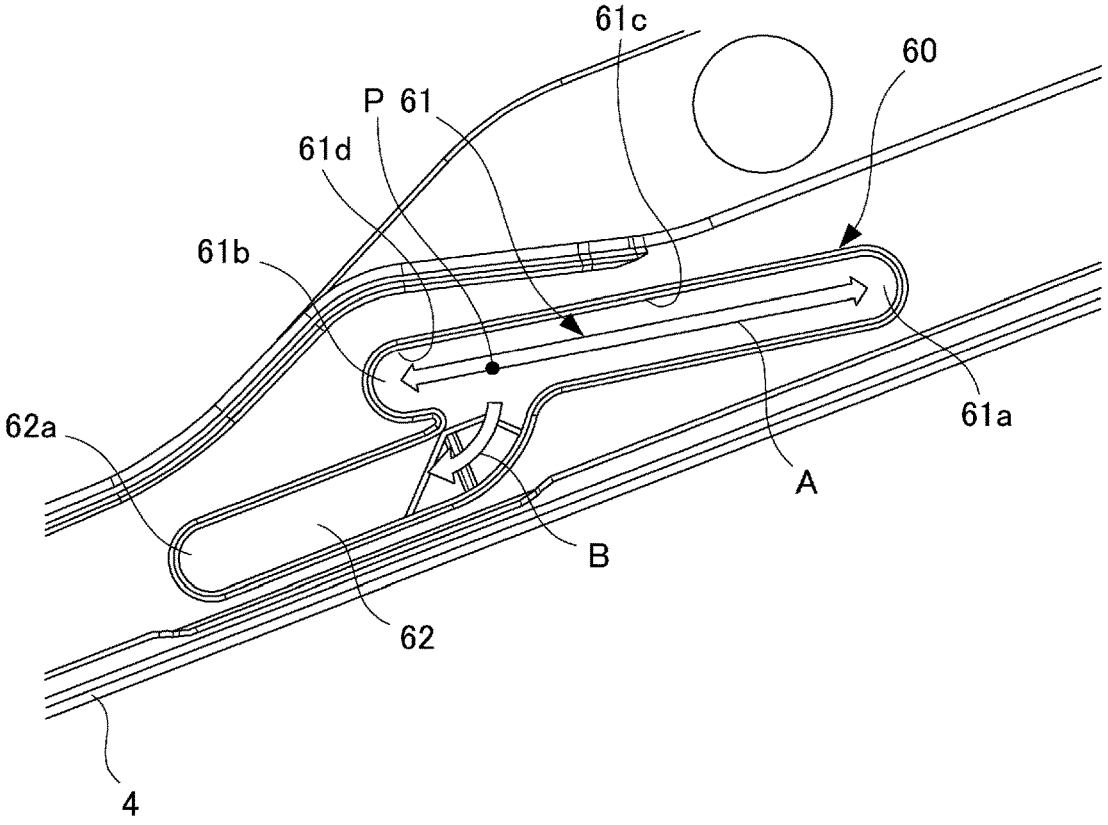

FIG. 6 is a drawing for describing the movement of the link portion of the sheet feeding apparatus.

Figure 7:
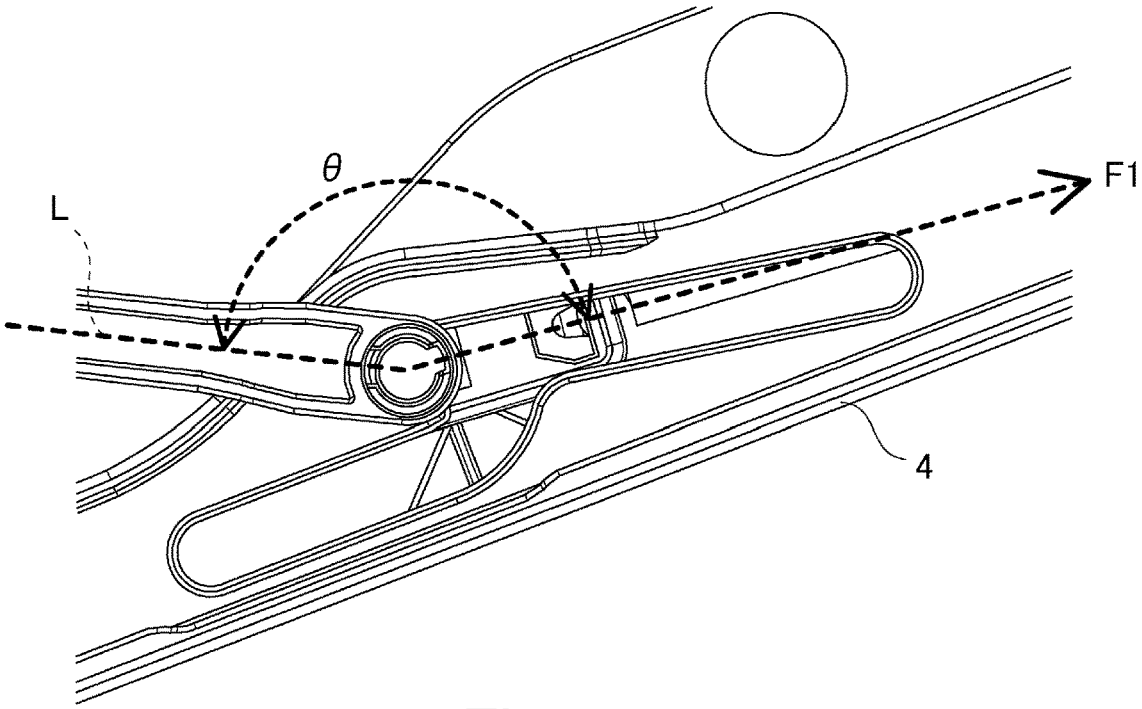

FIG. 7 is a drawing for describing the directions in which force is generated by the springs of the sheet feeding apparatus.

Figure 8:
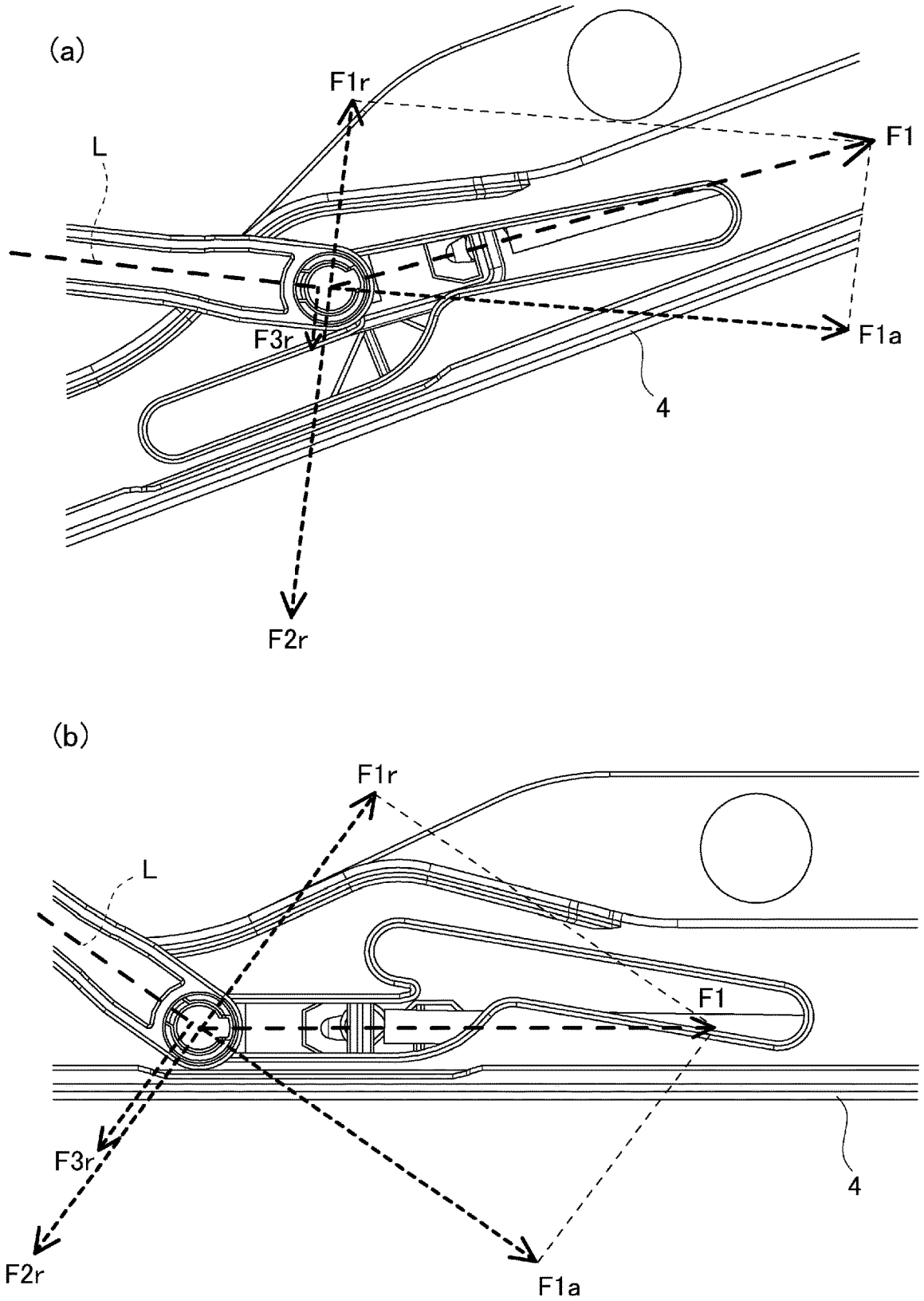

Parts (a) and (b) of FIG. 8 are views illustrating the relationship among the forces which act on the sheet supporting portion of the sheet feeding apparatus, part (a) of FIG. 8 being a drawing for describing the relationship when the sheet supporting portion is in the first state of being open, and part (b) of FIG. 8 being a drawing for describing the relationship when the sheet supporting portion is in the second state of being open.

Figure 9:
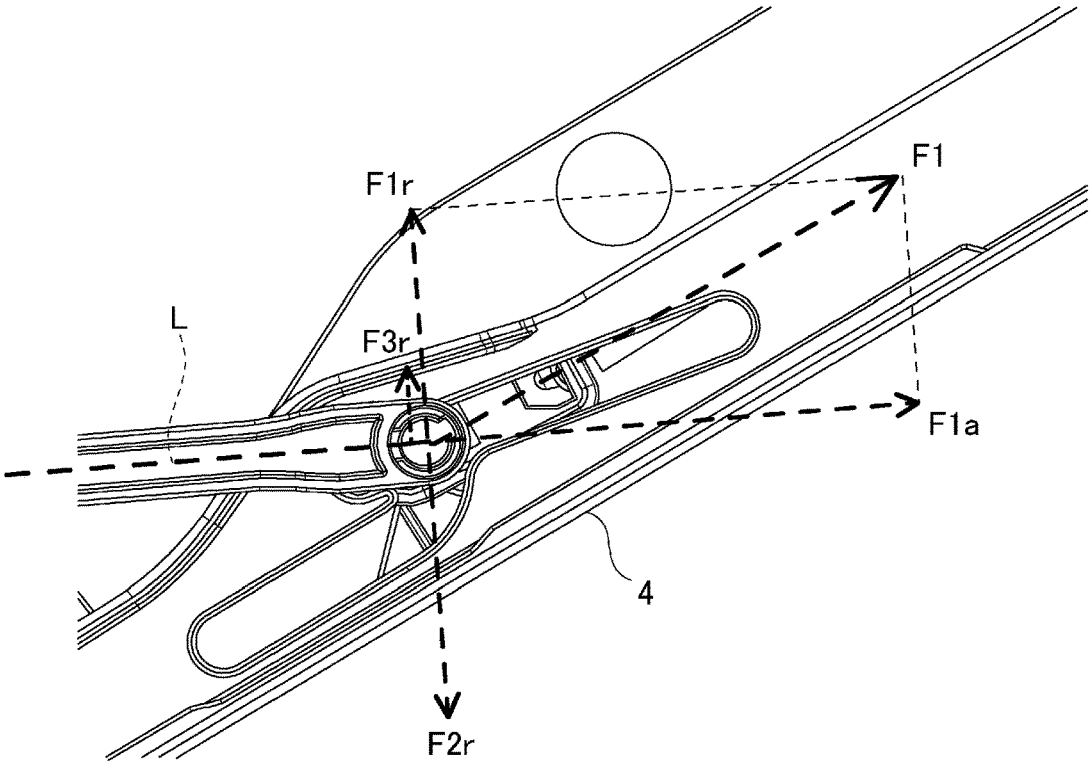

FIG. 9 is a drawing for describing the relationship among the forces which act on the sheet supporting portion when the link slider is in its sliding range.

Figure 10:
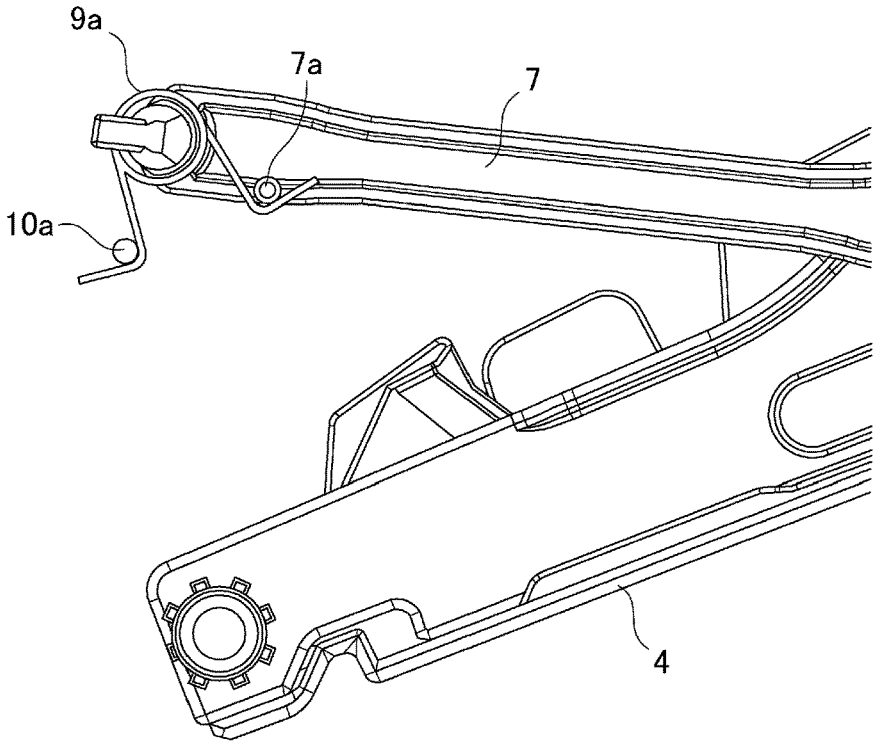

FIG. 10 is a schematic drawing of a combination of the tray link and manual feeding tray of a sheet feeding apparatus which employs a torsional coil spring in place of a tensional spring.

DESCRIPTION OF THE EMBODIMENTS

<Overall Structure of Printer>

Figure 1:
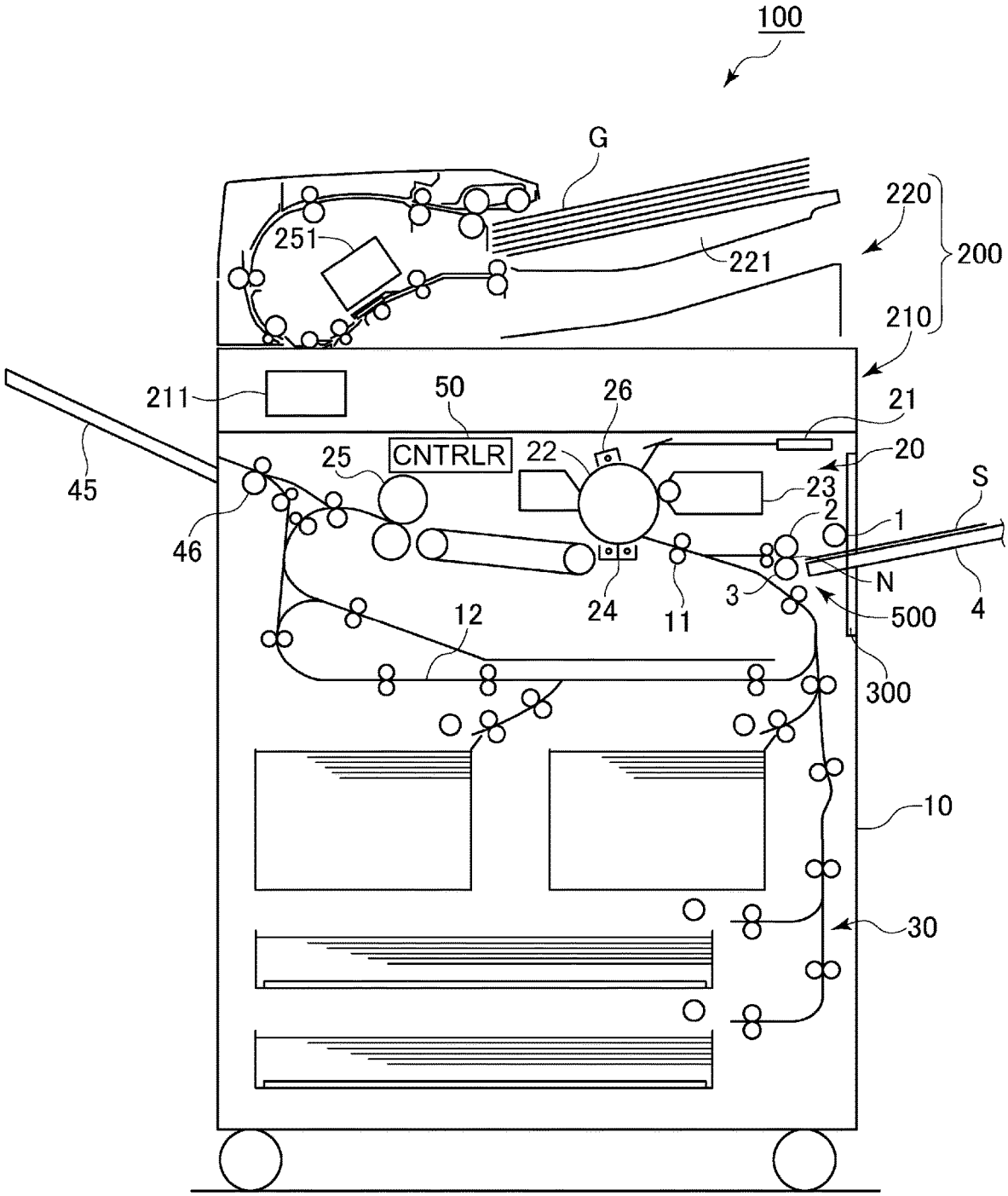
FIG. 1 is a schematic sectional view of the image forming apparatus in the first embodiment of the present invention; it shows the general structure of the apparatus.

Hereinafter, the sheet feeding apparatus and image forming apparatus in this embodiment of the present invention are described referring to appended drawings. To begin with, referring to FIG. 1, the image forming apparatus in this embodiment is described. In FIG. 1, a printer 100, which is an image forming apparatus, is a laser beam printer. It uses an electrophotographic image forming method. The printer 100 is provided with: an image reading apparatus 200 which is capable of reading the original Gin an original placement tray 221; and a main assembly 10, which is in a casing and is capable of forming an image of the image (original G) read by the image reading apparatus 200, on a sheet of recording medium. Further, the printer 100 is provided with a controlling portion 50 which controls the image reading apparatus 200 and apparatus main assembly 10.

The image reading apparatus 200 has the first and second reading portions 211 and 251. It has also a scanning portion 210 which reads the original G, and an automatic original feeding apparatus (ADF) 220 which is capable of automatically feeding the original G into the scanning portion 210. The first reading portion 211 is a reading portion which is to be used to read the first surface (front surface) of the original G when the original G is moved relative to the image reading apparatus 200, or kept stationary. The second reading portion 251 is a reading portion which is to be used to read the second surface (back surface) of the original G when the original G is moved relative to the image reading apparatus 200.

The apparatus main assembly 10 has: an image forming portion 20 which forms an image on a sheet S of recording medium; an internal sheet feeding portion 30 which feeds sheets S of recording medium stored within the apparatus main assembly 10, to the image forming portion 20; and a manual sheet feeding portion 500 as an external sheet feeding apparatus. Further, the apparatus main assembly 10 has: a pair of discharge rollers 46 which discharge a sheet S of recording medium out of the apparatus main assembly 10 after the formation of an image on the sheet S; and a delivery tray 45 into which sheets S of recording medium are cumulatively discharged from the apparatus main assembly 10.

The image forming portion 20 has: a photosensitive drum 22 on which a toner image is formed; a laser scanner unit 21 which scans the peripheral surface of the photosensitive drum 22 with a beam of laser light; a transferring portion 24 which transfers the toner image onto a sheet S of recording medium; and a fixing portion 25 which fixes a toner image. In the sheet conveyance passage through which sheets S of recording medium are conveyed, a pair of registration rollers 11 are disposed on the upstream side of the transferring portion 24.

Next, the image forming operation of the printer 100 is described with reference to a case in which an image is formed on a sheet S of recording medium fed into the apparatus main assembly 10 from the manual sheet feeding portion 500, based on the information of the original G read by the scanning portion 210. A beam of laser light is project from the laser scanner unit 21 while being modulated according to the information of the original G, which is obtained (read) by the scanning portion 210, in a manner to scan the peripheral surface of the photosensitive drum 22. The photosensitive drum 22 is charged in advance (prior to scanning of photosensitive drum 22) by a charging member 26. As the charged peripheral surface of the photosensitive drum 22 is scanned by the beam of laser light, an electrostatic latent image is formed on the peripheral surface of the photosensitive drum 22. Then, the electrostatic latent image is developed by a developing device 23, into a visible image (image formed of toner); a visible image is formed on the peripheral surface of the photosensitive drum 22. Hereafter, this visible image will be referred to as a toner image.

In parallel to the formation of a toner image on the photosensitive drum 22, the layered sheets S of recording medium in the manual feeding tray 4 of the manual sheet feeding portion 500 are fed one by one into the apparatus main assembly 10 from the manual feeding tray 4 of the manual sheet feeding portion 500, by a pickup roller 1. As each sheet S of recording medium is fed into the apparatus main assembly 10 by the pickup roller 1, it is conveyed to the pair of registration rollers 11 through a separation nip N between the feed roller 2 and retard roller 3. If two or more sheets of recording medium are fed together into the apparatus main assembly 10, the topmost one is separated from the rest by the coordination of the feed roller 2 and regard roller 3, in the separation nip N, and conveyed to the pair of registration rollers 11. Then, each sheet S is sent to the transferring portion 24 by the pair of registration rollers 11 in synchronism with the arrival of the toner image on the photosensitive drum 22 at the transferring portion 24.

The transferring portion 24 transfers the toner image on the photosensitive drum 22, which is formed in synchronism with the delivery of a sheet S of recording medium to the transferring portion 24 from the separation nip N after being separated from the rest, onto the sheet S. After the transfer of the toner image onto the sheet S in the transferring portion 24, the sheet S, and the toner image thereon, are heated and pressed in a fixing portion 25. Consequently, the toner image on the sheet S is fixed to the sheet S by combination of heat and pressure. After the fixation of the toner image to the sheet S, the sheet S is discharged into a delivery tray 45 by the pair of discharge roller 45, and is layered upon the sheets S in the tray 45. In a case where it is desired to form an image on both surfaces of a sheet S of recording medium, after the fixation of a toner image onto the first surface of the sheet S, the sheet S is conveyed to the pair of registration rollers 11 through a reversing sheet conveyance passage 12 to be subjected to the image forming operation described above.

<Manual Sheet Feeding Portion>

Next, referring to FIGS. 2-10, the manual sheet feeding portion 500 in this embodiment is described about its structure. The manual sheet feeding portion 500 has a manual feeding tray 4, in which sheets S of recording medium are loaded in layers. In the following description of the manual sheet feeding portion 500, the direction in which the manual feeding tray 4 is opened relative to the apparatus main assembly 100 (pivotally moved away from), and the direction in which the manual feeding tray 4 is closed relative to the apparatus main assembly 10 (pivotally moved toward the apparatus main assembly 10), will be referred to as "tray opening direction", and "tray closing direction", respectively.

FIGS. 2-4 are schematic drawings of the manual sheet feeding portion 500, which are different in the state of being open. They show the structure of the manual sheet feeding portion 500. In terms of the direction in which the manual feeding tray 4 is opened or closed, the position of the manual feeding tray 4, which is shown in FIG. 2, is where the manual feeding tray 4 will be as the manual feeding tray 4 is pivotally moved away from the apparatus main assembly 10 to be used for feeding sheets S of recording medium into the apparatus main assembly 10. This position, hereafter, will be referred to as "feeding position". The angle between the manual feeding tray 4 and the apparatus main assembly 10 when the manual feeding tray 4 is in this position is preset. Also in terms of the direction in which the manual feeding tray 4 is opened or closed, the position of the manual feeding tray 4, which is shown in FIG. 3, is where the manual feeding tray 4 will be as it is opened further from the feeding position, for the maintenance of the manual sheet feeding portion 500, for example, for the replacement of components, such as various rollers of the pickup roller 1. Hereafter, this position will be referred to as "maintenance position". Further, in terms of the direction in which the manual feeding tray 4 is opened or closed, is where the manual feeding tray 4 will be placed as the manual feeding tray 4 is folded up against the apparatus main assembly 100, for example when the manual sheet feeding portion 500 is not used for sheet feeding. That is, this is the position into which the manual feeding tray 4 is moved as the manual feeding tray 4 is folded up. This position will be referred to as "retraction position", hereafter.

The manual sheet feeding portion 500 has: the manual feeding tray 4; the pickup roller 1 as a sheet feeding portion: a combination of the feed roller 2 and retard roller 3 as a sheet separating portion; a combination of a tray link 7 and a link slider 8 as a linking portion. Referring to part (b) of FIG. 2, the manual sheet feeding portion 500 is structured so that when the manual feeding tray 4 is in its feeding position, the pickup roller 1 is enabled to feed the sheets S of recording medium supported by the manual feeding tray 4, into the apparatus main assembly 10, and also, so that the combination of the feed roller 2 and retard roller 3 is enabled to separate each of the sheets S from the rest as the sheets S are fed into the apparatus main assembly 10 by the pickup roller 1.

The manual feeding tray 4 is supported by the apparatus main assembly 10 in such a manner that it is enabled to hold sheets S of recording medium, and can be opened or closed relative to the apparatus main assembly 10. The manual feeding tray 4 is structured so that sheets S of recording medium can be feed into the apparatus main assembly 100 from the manual feeding tray 4. Referring to FIG. 5, the manual feeding tray 4 is provided with a guiding portion 60 for guiding the tray link 7 and link slider 8. The guiding portion 60 has a main rail 61 as the first guide, and a sub-rail 62 as the second guide. The sub-rail 62 branches diagonally downward from the main rail 61 at a branching point P. Referring to FIG. 6, the main rail 61 has the first portion 61*c* and a second portion 61*d*. The first portion 61*c* is the portion of the main rail 61, which is between the first end 61*a* of the main rail 61, and the branching point P. The second portion 61*d* is the portion of the main rail 61, which is between the branching point P and the second end 61*b* of the main rail 61. That is, the guide portion 60 has: the second portion 61*d* which extends from the branching point P to the second end 61*b*, and is different in direction from the sub-rail 62; and the sub-rail 62 which extends from the branching point P to the second end 61*a*. That is, the first end 61*a* is the lengthwise end of the main rail 61, by which the link slider 8 is supported when the manual feeding tray 4 is in its retraction position (closed position), that is, when it is closed. The second end 61*b* is the other lengthwise end of the main rail 61, by which the link slider 8 is supported when the manual feeding tray 4 is in its feeding position (first open position). The first portion 61*c* functions as a guide which guides the tray link 7 and link slider 8 when the manual feeding tray 4 is changed in state from the state of remaining closed to the state of being open. The second portion 61*d* has the second end 61*b*, which supports the tray link 7 and link slider 8 when the manual feeding tray 4 is in the first state of being open. It functions as a guide for guiding the tray link 7 and link slider 8, between the branching point P and second end 61*b*. The sub-rail 62 has an end 62*a* which supports the tray link 7 and link slider 8 when the manual feeding tray 4 is in the maintenance position, that is, when the manual feeding tray 4 is in the second state of being open (second open position). Further, referring to part (a) of FIG. 2, the manual feeding tray 4 is provided with a protrusive tray engaging portion 5 structured so that it can fit into the unillustrated recess with which the apparatus main assembly 10 is provided. When the manual feeding tray 4 is in its retraction position, the tray engaging portion 5 remains fitted in the recess of the apparatus main assembly 10, and keeps the manual feeding tray 4 in its retraction position.

In order to enable a user to put the manual feeding tray 4 in the retraction position in which the manual feeding tray 4 is in the state of being closed, feeding position in which the manual feeding tray 4 is in the first state of being open, or maintenance position in which the manual feeding tray 4 is in the second state of being open, the manual sheet feeding portion 500 is structured so that it can be changed in which portion of the guide portion 60 supports the tray link 7 and link slider 8. The tray link 7 is rotatably supported by the apparatus main assembly 10. Further, referring to part (b) of FIG. 3, the tray link 7 has the link slider 8, as an engaging portion, which is in engagement with the manual feeding tray 4 in such a manner that it slidingly moves relative to the manual feeding tray 4. The link slider 8 is in connection to the tray link 7 with the placement of an unillustrated boss between itself and tray link 7. Further, the manual sheet feeding portion 500 is structured so that the link slider 8 is allowed to slidingly move relative to main rail 61 and sub-rail 62, with which the manual feeding tray 4 is provided, remaining in contact with the two rails 61 and 62. That is, the manual sheet feeding portion 500 is structured so that the link slider 8 is allowed to slidingly move between the first end 61*a* and second end 61*b*, and between the first end 61*a* and end 62*a*, remaining in contact with the rails 61 and 62, as indicated by arrow marks A and B in FIG. 6.

Further, the manual sheet feeding portion 500 is provided with a tray link spring 9, which is between the link slider 8 and manual feeding tray 4. One end of the tray link spring 9 is in connection to the link slider 8, whereas the other end is in connection to a hook-like engaging-supporting element (unshown), with which the manual feeding tray 4 is provided, being thereby supported by the element. Thus, the tray link 7 and link slider 8 remain pressured by the tray link spring 9, in the direction in which the manual feeding tray 4 is retracted. Referring to FIG. 7, a letter L stands for a straight line which connects the rotational axis of the tray link 7 and the center of the joint between the link slider 8 and tray link 7 when the rotational axis of the tray link 7 is seen from the direction of the rotational axes of the tray link 7 and link slider 8. A letter θ stands for the angle between the axial line L of the tray link 7 and the force F1 which is generated by the tray link spring 9 and acts on the link slider 8. In this case, in order for the tray link 7 and link slider 8 to be pressured in the direction to retract the manual feeding tray 4 while the manual feeding tray 4 is in the first state of being open, the angel θ has to be obtuse, that is, it has to be greater than 90° and smaller than 180°. Therefore, if the manual sheet feeding portion 500 is structured so that the positioning of the tray link 7 and direction of the force F1 satisfy: $90° < \theta < 180°$, when the manual feeding tray 4 is in the first state of being open, the tray link 7 and link slider 8 are pressured in the tray retraction direction.

Next, the manual sheet feeding portion 500 structured as described above is described about its action. The manual sheet feeding portion 500 is structured so that its manual feeding tray 4 can be placed in one of the three positions in terms of its angle relative to the surface of one of the lateral walls of the apparatus main assembly 100, into which the manual feeding tray 4 is to be retracted. That is, the manual sheet feeding portion 500 is structured so that its manual feeding tray 4 can be placed in one of three positions, that is, the retraction position (angle), feeding position, and the maintenance position. These positions are related to the positioning of the link slider 8. When the manual feeding tray 4 is in the retraction position, the link slider 8 is held by the first end 61*a* of the main rail 61. When the manual feeding tray 4 is in the feeding position, the link slider 8 is held by the second end 61*b* as the first supporting portion. When the manual feeding tray 4 is in the maintenance position, the link slider 8 is held by the end 62*a* as the second supporting portion.

If a user wants to move the manual feeding tray 4 from the retraction position to the feeding position, that is, the user wants to change the manual feeding tray 4 in state from the state of remaining closed to the state of being open, all that is necessary for the user to do is to open the manual feeding tray 4, that is, to pivotally move the manual feeding tray 4 away from the apparatus main assembly 10, without applying to the manual feeding tray 4, such pressure that counters the force F1. Hereafter, this action will be referred to as "normal opening operation". As the manual feeding tray 4 is normally opened, the link slider 8 is guided from the end 61*a* to the branching portion P, and then, from the branching portion P into the second portion 61*d*, which extends in the different direction from the sub-rail 62, until it is positioned by the second end 61*b*. By the way, in terms of the direction in which the manual feeding tray 4 is retracted, the main rail 61 is on the downstream side of the sub-rail 62. Further, the tray link 7 and link slider 8 are under such pressure that works in the direction to retract the manual feeding tray 4. Therefore, it does not occur during the normal opening action that when the manual feeding tray 4 is changed in state from remaining retracted to being open, the tray link 7 and link slider 8 are guided by the sub-rail 62 which branches away from the main rail 61 at the branching portion P. That is, during the normal opening of the manual feeding tray 4, the link slider 8 slidingly moves along the main rail 61, without being guided by the sub-rail 62.

Further, when the manual feeding tray 4 is in the feeding position, the link slider 8 is held by the setting of the force F1, for example, among the forces which act on the manual feeding tray 4 when the manual feeding tray 4 is supported in such a manner that the force which works in the direction to open the tray becomes smaller than the force which works in the direction to open the manual feeding tray 4. Referring to part (a) of FIG. 8, among the forces which act on the manual feeding tray 4 when the manual feeding tray 4 is in the feeding position, the force which works in the direction to close the manual feeding tray 4 is generated by the force F1, whereas the force which works in the direction to open the manual feeding tray 4 is generated by gravity. It is assumed here that the force F1 generated by the tray link spring 9, and the gravitational force, can be divided into a component which works in the rotational direction of the tray link 7 and affects the opening or retracting the manual feeding tray 4, and the direction which is parallel to the axial line of the tray link 7.

Referring to FIG. 8, components F1*r* and F1*a* are such components of the force F1 that act on the joint between the tray link 7 and link slider 8, in the direction to rotationally move the joint, and in the direction parallel to the axial line of the joint (this rotational direction will be referred to as "link rotation direction, hereafter), respectively. The component F2*r* is such component of the gravitational force that the manual feeding tray 4 receives and acts on the joint between the tray link 7 in the link rotation direction. Regarding the relationship between the components F1*r* and F2*r*, the force F1 is to be set so that the components F1*r* becomes smaller than the component F2*r*.

With the force F1 being set as described above, the moment which the tray link spring 9 gives to the manual feeding tray 4 by way of the link slider 8 is opposite in direction from the moment generated by the weight of the manual feeding tray 4 itself when the manual feeding tray 4 is in its feeding position. The magnitude of the component F1*r* of the force F1 is smaller than that of the moment which is generated by the weight of the manual feeding tray 4 itself when the manual feeding tray 4 is in the feeding position. Therefore, the link slider 8 is restricted in movement by the second end 61*b*, and is positioned by the second end 61*b*.

By the way, strictly speaking, friction is generated by the force F1 in the interface between the link slider 8 and manual feeding tray 4. A component F3*r* of the friction F3*r* in terms of the rotational direction of the manual feeding tray 4 is the same in direction as the component F2*r*. Therefore, the force F1 may be set in consideration of this component F3*r*. That is, the force F1 may be set so that the component F1*r* becomes smaller than a combination (F2*r*+F3*r*) of the components F2*r* and F3*r*. Further, it is far better to set the force F1 so that in the area in which the link slider 8 slidingly moves, the sum (F1*r*+F3*r*) of the component F1*r*, and component F3*r* (which is component of friction F3 which is parallel to rotational direction of tray 4) becomes smaller than the component F2*r* of the gravitational force which is parallel to the rotational direction of the manual feeding tray 4. In such a case, it is possible to design the manual sheet feeding portion 500 so that even if the user removes his or her hand from the manual feeding tray 4 during the normal opening of the manual feeding tray 4 before the manual feeding tray 4 moves into the feeding position, the manual feeding tray 4 moves into the feeding position.

On the other hand, if a user wants to close (retract) the manual feeding tray 4 when the manual feeding tray 4 is in the state of being open, the user is to carry out the operation for closing the manual feeding tray 4. As the operation to close the manual feeding tray 4 is carried out by the user, the link slider 8 slides from the second end 61*b* toward the first end 61*a*, and then, is fixed in position by the fend 61*a*. As the manual feeding tray 4 is pivotally moved into in the retraction position, the tray-engaging portion 5, which is shown in part (a) of FIG. 2, engages into the unillustrated recess of the apparatus main assembly 10. Therefore, the manual feeding tray 4 remains closed. By the way, from the standpoint of preventing the manual feeding tray 4 from colliding with the apparatus main assembly 10 when the manual feeding tray 4 is retracted into the apparatus main assembly 10, the manual sheet feeding portion 500 may be structured (link slider 8 and guiding portion are structured) so that the link slider 8 remains in the guiding portion 60.

Next, a case in which manual feeding tray 4 is moved into the maintenance position from the feeding position or retraction position, that is, a case in which the manual feeding tray 4 is changed in state from the first state of being open to the second state of being open, is described. If a user wants to put the manual feeding tray 4 in the second state of being open when the manual feeding tray 4 is in the first state of being open or state of being closed, the user is to apply to the manual feeding tray 4, such force that is opposite in direction, so that the tray link 7 and link slider 8 are guided into the sub-rail 62. As the tray link 7 and link slider 8 are guided into the sub-rail 62 which branches from the main rail 61, the link slider 8 slides within the sub-rail 62, and then, is fixed in position by the end 62*a* of the sub-rail 62.

The operation to fix the link slider 8 in position when the manual feeding tray 4 is in the maintenance position is similar to the operation to fix the link slider 8 in position when the manual feeding tray 4 is in the feeding position. That is, referring to part (b) of FIG. 8, the manual sheet feeding portion 500 is designed so that the component of the force F1, which acts in the direction to ? open the manual feeding tray 4, will be smaller than the component of the force F2, which acts in the direction to close the manual feeding tray 4. To describe this concept with reference to the relationship between the components F1*r* and F2*r* shown in part (b) of FIG. 8, the manual sheet feeding portion 500 is designed so that the component F1*r* becomes smaller than the component F2*r*.

With the force F2 being set as described above, the moment which the tray link spring 9 generates in the manual feeding tray 4 by way of the link slider 8 becomes opposite in direction from the moment which is generated in the manual feeding tray 4 by the weight of the manual feeding tray 4 itself when the manual feeding tray 4 is in the maintenance position. Further, the component F1*r* of the force F1 becomes smaller than the moment generated by the weight of the manual feeding tray 4 itself when the tray is in the maintenance position. Thus, the sliding of the link slider 8 is restricted by the end 62*a* of the sub-rail 62. That is, the link slider 8 is fixed in position by the end 62*a*.

If a user wants to change the manual feeding tray 4 in state from being in the second state of being open to being closed, is similar to the operation to change the manual feeding tray 4 in state from being in the first state of being open to being closed. That is, the user has only to shut the manual feeding tray 4 against the apparatus main assembly 10. As the operation to shut the manual feeding tray 4 is started, the link slider 8 begins to slide from the end 62*a* in the opposite direction from the direction indicated by the arrow mark B (FIG. 6), that is, toward the first end 61*a* of the main rail 61. Then, the link slider 8 is guided out of the sub-rail 62, and into the first portion 61*c* of the main rail 61 through the branching portion P. Then, it is fixed in position by the first end 61*a*.

If a user wants to change the manual feeding tray 4 in state from the second state of being open to the first state of being open, the user is to shut the manual feeding tray 4 against the apparatus main assembly 10 to change the manual feeding tray 4 in state from the state of being open into the state of being closed, and then, to carry out the normal opening operation. That is, the operation to change the manual feeding tray 4 in state from the second state of being open to the first state of being open has to go through the state of being shut.

As described above, it is assured that in a case where the manual feeding tray 4 is opened through the normal opening operation when the manual feeding tray 4 is remaining completely retracted, the manual feeding tray 4 is changed in state into the first state of being open, without being put into the second state of being open. That is, as long as the manual feeding tray 4 is opened through the normal opening operation while it is in the retraction position, it is assured that the manual feeding tray 4 is held in the feeding position.

With the manual sheet feeding portion 500 being structured as described above, unless a user intentionally guide them into the sub-rail 62, it does not occur that the tray link 7 and link slider 8 are guided into the sub-rail 62 from the main rail 61. Therefore, in the normal opening operation, the link slider 8 moves along the main rail 61 without moving into the sub-rail 62. Therefore, it is possible to prevent such an error that the manual feeding tray 4 is moved into the maintenance position (second state of being open) while sheets S of recording medium are fed into apparatus main assembly 10. That is, according to the present invention, it is possible to prevent a user from forgetting to move the manual feeding tray 4 into the feeding position (first state of being open) after the completion of maintenance operation.

Further, according to the present invention, it is possible to move the manual feeding tray 4 into the maintenance position without disengaging the manual feeding tray 4 from the apparatus main assembly 10. Therefore, it is possible to secure a large operational space on the top side of the manual feeding tray 4, without the need for removing the manual feeding tray 4 from the apparatus main assembly 10 with the use of tools. That is the present invention can make it easier for a user to access such components of the manual sheet feeding portion 500 as the pickup roller 1, feed roller 2, and retard roller 3, from the direction of the manual feeding tray 4, improving the manual sheet feeding portion 500 in maintainability.

According to the present invention, the manual sheet feeding portion 500 is structured so that when the manual feeding tray 4 is in the feeding position, the moment which the tray link spring 9 generates in the manual feeding tray 4 is opposite in direction from the moment generated in the manual feeding tray 4 by the gravitational force which the manual feeding tray 4 receives when the manual feeding tray 4 is in the feeding position, and also, is smaller than the moment generated in the manual feeding tray 4 by the gravitational force which the manual feeding tray 4 receives when the manual feeding tray 4 is in the feeding position. Therefore, even after the user releases the manual feeding tray 4 from his or her hand, the manual feeding tray 4 remains in the feeding position. In other words, it is possible to hold the manual feeding tray 4 in the feeding position without employing an elastic component. Further, when the manual feeding tray 4 is in the feeding position, the manual feeding tray 4 is under the force which acts in the direction to close the manual feeding tray 4. This force functions to assist the user to move the manual feeding tray 4 from the feeding position into the retraction position.

According to the present invention, the manual sheet feeding portion 500 is structured so that when the manual feeding tray 4 is in the maintenance position, the moment generated in the manual feeding tray 4 by the tray link spring 9 is smaller than the moment generated in the manual feeding tray 4 by the gravitational force which the manual feeding tray 4 receives when the manual feeding tray 4 is in the feeding position, and also, is opposite in direction from the moment generated in the manual feeding tray 4 by the gravitational force which the manual feeding tray 4 receives when the manual feeding tray 4 is in the feeding position. Therefore, even if the user removes his or her hand from the manual feeding tray 4 when the manual feeding tray 4 is in the maintenance position, the manual feeding tray 4 does not close; the manual feeding tray 4 remains in the maintenance position. Further, when the manual feeding tray 4 is in the maintenance position, it is under the force which acts in the direction to close the manual feeding tray 4. This force helps the user to move the manual feeding tray 4 from the maintenance position in the direction to shut the manual feeding tray 4 against the apparatus main assembly 10.

Moreover, according to the present invention, the manual sheet feeding portion 500 is structured so that the tray link 7 and link slider 8 remain under the pressure generated by the tray link spring 9 placed between the tray link 7 and link slider 8. Therefore, when the manual feeding tray 4 is opened relative to the apparatus main assembly 10, the tray link spring 9 functions as a damper, preventing the occurrence of banging noises, and/or to prevent such structural components of the manual sheet feeding portion 500 as the tray link 7 and link slider 8, which are related to the supporting of the manual feeding tray 4, from becoming damaged when the manual feeding tray 4 is opened. That is, according to the present invention, it is possible to prevent the manual sheet feeding portion 500 from erroneously feeding sheets of recording medium into the apparatus main assembly 10, without reducing the manual sheet feeding portion 500 in maintainability.

By the way, the preceding embodiment of the present invention is not intended to limit the present invention is scope in terms of its application. That is, the present invention can be embodied in various forms other than the manual sheet feeding portion 500 in the preceding embodiment, within the gist of the present invention. For example, in the preceding embodiment, the tray link spring 9 was a tension spring. However, the present invention is applicable to a manual sheet feeding portion (apparatus), the tray link spring of which is a compression spring, a torsional spring, or the like. More concretely, in a case where a compression spring is employed in place of the tray link spring 9, the compression spring is to be symmetrically placed relatively to where the tray link spring 9 was in the preceding embodiment, on the opposite side of the center of the joint between the tray link 7 and link slider 8. Further, in a case where a compression spring is employed in place of the tray link spring 9, a manual sheet feeding portion (apparatus) is to be structured so that the force generated by the compression spring satisfies the requirement regarding the force F1 and angle θ. Even in a case where a manual sheet feeding portion is structured to employ a compression spring in place of the tray link spring 9, effects similar to those obtainable by the manual sheet feeding portion 500 which employs the tray link spring 9 which is a tension spring can be expected. Further, referring to FIG. 10, in a case where a torsional coil spring 9*a* is employed in place of the tray link spring 9, a manual sheet feeding portion is to be designed so that the actual coil portion of the torsional coil spring 9*a* is placed at one end of the apparatus main assembly 10 in such a manner that one end of the torsional coil spring 9*a* is anchored to the spring seat portion 7*a*, and the other end is anchored to the spring seat portion 10*a*. With the torsional coil spring 9*a* being attached as described above, the tray link 7 is kept pressed in the counterclockwise direction of FIG. 10. Further, the manual sheet feeding portion and torsional coil spring 9*a* are to be designed so that the rotational force applied to the joint between the tray link 7 and link slider 8 by the torsional coil spring 9*a* satisfies the requirement regarding the setting of the component F1*r* generated by the tray link spring 9. By structuring a manual sheet feeding portion which employs a torsional coil spring such as the above-described one 9*a*, it is possible to expect effects similar to those obtainable by the manual sheet feeding portion 500 which employs the tray link spring 9 which is a tension spring.

Further, in the embodiment described above, the image forming apparatus was an electrophotographic printer 100. However, the present invention is also applicable to various image forming apparatus of the so-called inkjet type. Further, in the embodiment described above, the manual sheet feeding portion 500 was structured so that the manual feeding tray 4 is provided with the guiding portion 60. However, the preceding embodiment is not intended to limit the present invention in application, in terms of the component of the manual sheet feeding portion, which is provided with the guiding portion 60. That is, the present invention is also compatible with a structural component, such as a door 300 (FIG. 1), of an image forming apparatus, which can be opened or closed relative to the apparatus main assembly 10.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-045879 filed on Mar. 13, 2018, which is hereby incorporated by reference herein in its entirety.

What is claimed is:

1. A sheet feeding apparatus comprising:

a casing;

a sheet stacking unit configured to accommodate a stack of sheets, said stacking unit is movable relative to said casing to open and close said casing;

a sheet feeding unit configured to feed the sheet from said sheet stacking unit;

a link unit rotatably supported by said casing, said link unit being provided with an engaging portion slidably engaged with said sheet stacking unit;

a spring configured to urge said link unit relative to said casing in a closing direction, wherein said sheet stacking unit is rotatable between a closing position for closing said casing, a first opening position for opening said casing by a predetermined angle, and a second opening position for opening said casing by an angle larger than the predetermined angle, and said sheet stacking unit including, a first guide configured to guide said engaging portion when said sheet stacking unit is opened from the closing position to the first opening position, and a second guide configured to guide said engaging portion when said sheet stacking unit is opened from the first position to the second position, said second guide branching from said first guide, wherein said first guide includes, a first portion configured to guide said engaging portion to said branch portion when said sheet stacking unit rotates from the closing position to the first opening position, a first supporting portion configured to support said engaging portion when said sheet stacking unit is in the first opening position, said first supporting portion extending from said branch portion in a direction different from a direction in which said second guide extends, and a second portion configured to guide said engaging portion between said branch portion and said first supporting portion, wherein said second guide includes a second supporting portion configured to support said engaging portion when said sheet stacking unit is in the second opening position and configured to guide said engaging portion between said branch portion and said second supporting portion, wherein said engaging portion is guided from said second guide to said first portion of said first guide by said sheet stacking unit being closed from the second opening position, and said engaging portion is guided from said first portion of said first guide to said second portion by way of said branch portion by said sheet stacking unit being opened from the closed state.

2. An apparatus according to claim 1, wherein a moment applied to said sheet stacking unit by said spring by way of said engaging portion when said sheet stacking unit is in the first opening position has a direction opposite to that of a first moment resulting from a weight of said sheet stacking unit and is smaller than the first moment, the first moment including a moment resulting from a friction between said sheet stacking unit and said engaging portion.

3. An apparatus according to claim 1, wherein said sheet stacking unit is held in the first opening position when said engaging portion is supported by said first supporting portion.

4. An apparatus according to claim 1, wherein a moment applied to said sheet stacking unit by said spring by way of said engaging portion when said sheet stacking unit is in the second opening position has a direction opposite to that of a second moment resulting from a weight of said sheet stacking unit and is smaller than the second moment, the second moment including a moment resulting from a friction between said sheet stacking unit and said engaging portion.

5. An apparatus according to claim 1, wherein said sheet stacking unit is held in the second opening position when said engaging portion is supported by said second supporting portion.

6. An apparatus according to claim 1, wherein said spring is disposed between said engaging portion and said sheet stacking unit.

7. An apparatus according to claim 6, wherein when said sheet stacking unit is in the first position, an angle formed between an urging direction of said spring and a line connecting between a rotational center of said link unit and said engaging portion is larger than 90° and smaller than 180°.

8. An image forming apparatus, further comprising a sheet feeding apparatus according to claim 1, and an image forming unit configured to form an image on the sheet fed by said sheet feeding apparatus.

* * * * *